US005522194A

United States Patent [19]

Graulich

[11] Patent Number: 5,522,194

[45] Date of Patent: Jun. 4, 1996

[54] STRUCTURAL BEARING PANEL AND PANEL CORE FOR BUILDING

[76] Inventor: Peter W. P. Graulich, 250 Catalonia Ave., Ste. 502, Coral Gables, Fla. 33134

[21] Appl. No.: 223,244

[22] Filed: Mar. 25, 1994

[51] Int. Cl.[6] ..... E04C 1/00

[52] U.S. Cl. ..... 52/309.4; 52/309.12; 52/405.1

[58] Field of Search ..... 52/309.4, 309.12, 52/309.17, 344, 348, 349, 354, 356, 806, 809, 811, 404.1, 405.3, 405.1

[56] References Cited

U.S. PATENT DOCUMENTS

| | | | |
|---|---|---|---|
| 3,990,202 | 11/1976 | Becker | 52/172 |
| 4,611,450 | 9/1986 | Chen | 52/309.12 X |
| 5,129,203 | 7/1992 | Romero | 52/309.12 X |
| 5,335,472 | 8/1994 | Phillips | 52/309.12 X |

*Primary Examiner*—Creighton Smith
*Attorney, Agent, or Firm*—Malloy & Malloy

[57] ABSTRACT

A planar building panel core having two main faces coated with a cementitious material wherein the core includes an extruded, non-containing formaldehyde closed cell foam insulation board that is chemically inert, of high compressive strength, and of a low moisture absorbing quality. The board also includes an upper surface with opposite ends, a bottom surface of a length substantially equal to that of the upper surface and parallel side surfaces, and has a generally congruent sheet of metal lath on each main face, with each sheet having diamond-shape openings formed therein. Additionally, the building panel core includes a plurality of spaced commonly shaped metal furring vertical channel members which are to be fastened to a support structure and a steel reinforcing sheet spanning each board face.

13 Claims, 2 Drawing Sheets

STRUCTURAL BEARING PANEL AND PANEL CORE FOR BUILDING

BACKGROUND OF THE INVENTION

1. Field of the Invention

This invention relates to a structural building panel and particularly to a core for a building panel which is relatively lightweight and which can be transported to a job site at which, upon erection thereof, a hard coat of cementitious material may be applied interiorly and exteriorly on the main faces of the core to define a versatile, easy to install, relatively lightweight building panel with strength and excellent thermal resistance, the latter being an important feature of this invention.

2. Background of the Invention

There are many construction panels disclosed in the prior art and some of which have been utilized. It is preferable that a building construction panel is insulated insofar as heat transmitting qualities are concerned and preferably has favorable sound transmission qualities.

Many prior art building panels were erected at the construction site and cementitious material applied to opposing faces of the panels. A suitable cementitious material often used is concrete. When applied, it exerts a substantial amount of force, i.e., often at a pressure of about 25 pounds per square foot being applied to the main faces of the insulating core is not uncommon. This results in a construction panel which is not uniform and not acceptable.

SUMMARY OF THE INVENTION

This invention is of a core for a building panel which is load bearing and which preferably includes vertically extending reinforcing rods through it and wherein an insulation board with a lathed outer surface is provided with a reinforcing sheet with substantially large, preferably diamond-shaped openings which is held in spaced relation from the main face of the insulating panel and through which openings concrete may be applied to both sides of the reinforcing material so that the reinforcing material and the vertical channel members and support members and rigidifying members are embedded substantially midway of an exterior coat or bed of concrete.

It is a general object of this invention to provide a core which is simple in construction and in several embodiments which are described, easy to install, and is characterized by the insulation board being of high thermal resistance of longlasting R-value with a relatively high compressive strength and low moisture absorption and, further, in addition to being versatile and easy to install, is provided with a fire-resistant composition and which is resistant to soil chemicals, and which, at a job site, may be hard coated with cementitious material, preferably concrete providing a hard coated building panel.

DESCRIPTION OF PREFERRED EMBODIMENTS

Figures 1, 4, 5, 6:
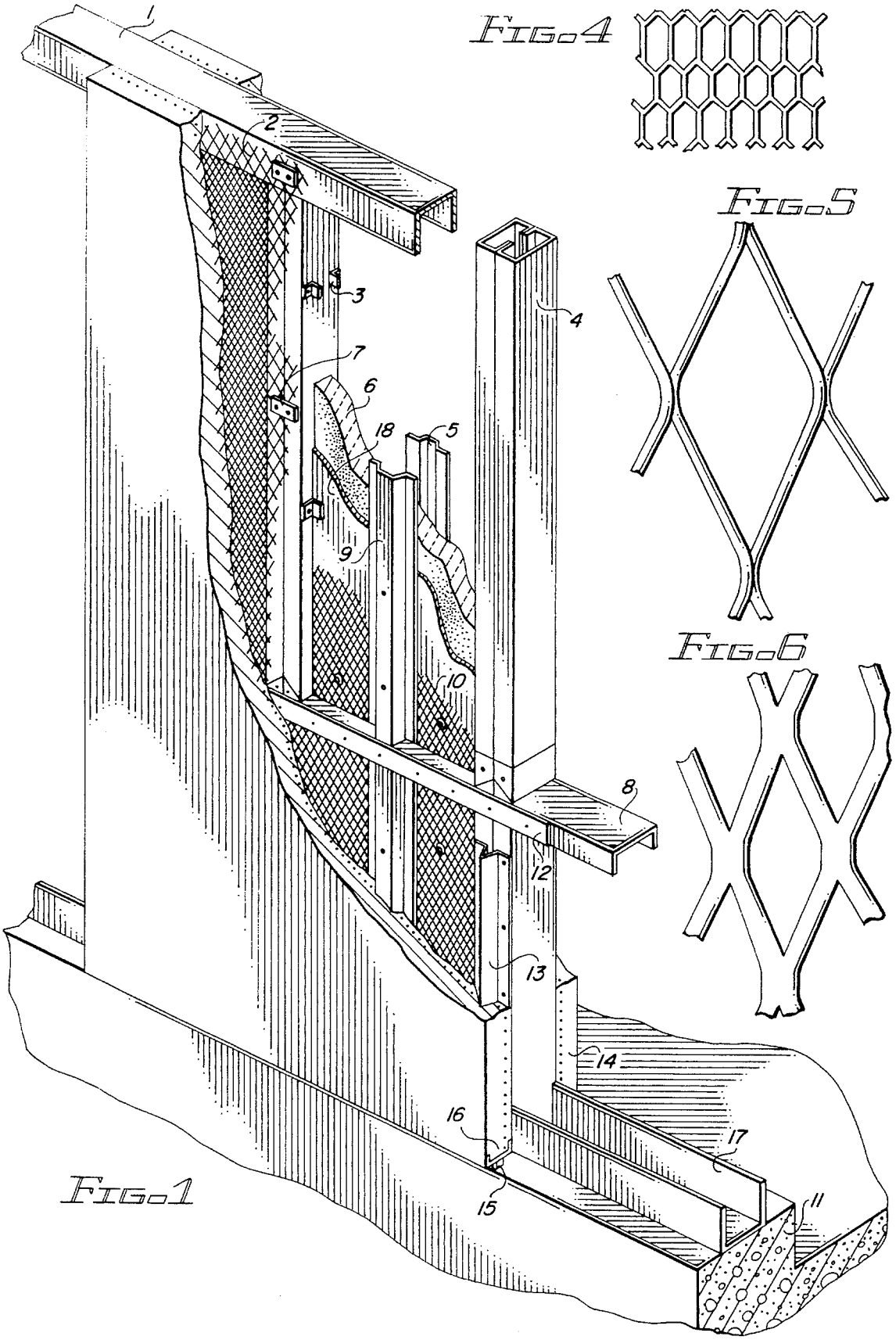
FIG. 1 is a perspective view illustrating a building panel constructed in accordance with this invention and being partially cutaway to show the core elements in assembly, which are exteriorly coated on their main faces by concrete which is applied thereto.
FIG. 4 is a view illustrating a preferred conventional "V" shaped plurality of grooves in adjacent diamond-shaped mesh.
FIG. 5 is a view of the reinforcing mesh shown to size and indicating the pattern in relief formed on the opposite main faces thereof.
FIG. 6 is a plan view of a single sheet of expanded steel one-piece metal sheet used as a security barrier as well as reinforcing means for the concrete in which it is embedded.

Referring to FIG. 1, there is shown a building panel in which there is a core to be described more fully hereinafter and which is exteriorly coated on its to main opposite faces with cementitious material. It is a relatively lightweight planar building panel core which is intended, to be erected in side-by-side relation with similar cores and the cores connected together prior to the application of the exterior coating of the cementitious material. It is seen that it is composed of a insulation board designated by the numeral 6, to which an expanded metal lath of the conventional type is applied, see FIG. 3 and as designated by the numeral 2 in FIG. 1. The core which is preferably 4 feet wide by 8 feet in height and 8 inches in depth is composed of a frame about the core members, the frame being composed of a six inch metal stud 4 along each of the longitudinal sides thereof and there are tracks or six inch steel channel members 1 and 17 at the top and the bottom thereof.

In a preferred embodiment, a radiant barrier 18 is provided in overlaying relation of at least one of the surfaces of the insulation board. The highly reflective surface of the radiant barrier further increasing the thermal resistance. Over the lath 2, a plurality of spaced parallel metal furring channels 5 are secured in a manner to be explained more fully hereinafter. The exterior surface of the web of the these furring channels are co-planar in each core and an aluminum angle clip 3 is preferably provided as indicated in the drawings. The furring channels may be considered as top hats or spacer means. Along the furring channels, there are specifically positioned through holes 9 to correspond with the metal furring channel on the opposite main face for a true leveling bolt to be received so that the core is properly assembled. Additionally, metal plates such as that designated by the numeral 7 may be provided in the event that a pair of metal studs is provided centrally in the core; that is, between the metal furring channels generally so that equi-spaced vertical members are arranged in the core. If desired, one core may be stacked or arranged on top of another through the use of a solid bridging or C-runner designated by the numeral 8.

The numeral 10 designates a metal lath which is a concrete reinforcing means, as described more fully hereinafter. It spans the main face of the insulation board 6 in spaced relation thereto defining a cavity which is substantially open by reason of the open work construction of the expanded reinforcing metal lath material. A preferred to size copy of a portion of this reinforcing means is seen in FIG. 5. To the bullhead 11 of a concrete footing, the cores may be arranged in side-by-side relation. In a preferred embodiment, a strap-type bracing, or suitable other bracing means, which extends horizontally, is provided for the core and a plastic lath or weep screed is provided as indicated in FIG. 1. To the outer surface and through the open work construction of the reinforcing mesh, cementitious material is applied and the reinforcing material, FIG. 5, is also exteriorly coated with the material so that the reinforcing lath in effect together with the metal furring channel 5 is embedded within the concrete or cementitious material. In use, a sealing and backup rod 16 may be utilized with the six inch steel channel 17 being coated, preferably, with about two inches of concrete and a plastic lath stop 16 provided as indicated.

It is thus seen that a lightweight building panel core is provided which is adapted to be moved to a job site at which its main faces will have a concrete inner and outer surface, preferably. In the preferred embodiment, the insulated central board is extruded, square edged, and relatively rigid. It does not contain formaldehyde and is of preferably closed cell foam polystyrene. This product is chemically inert, has high compressive strength, and low moisture absorbing qualities. Further, it is resistant to soil chemicals and contains a fire-resistant component. The outstanding feature of the board is that it has a resistance to heat flow or R-value, of about 5 per inch of thickness at about 75° Fahrenheit mean temperature and the R-value is of longlasting character. Generally, it is seen that the insulation board has an upper surface and a lower surface as well as a pair of parallel side surfaces, being generally rectangular in shape and preferably four feet by eight feet and three inches thick so that the overall thickness of a wall panel is substantially eight inches when concrete has been applied to exteriorly in about a two inch layer.

The insulation board preferably has at least the property values according to the below indicated tests for one square foot specimens:

| Property | Test | Value |
|---|---|---|
| Thickness (inches) | | ½, ⅝, 1, 1½, 2½, 3, 4 |
| Sheet Sizes (feet) | | 2' × 8', 4' × 8', 4' × 9' |
| R/Value (°F./ft.$^2$/hr./Btu$^{-1}$) | ASTM C518 | 5.0/inch @ 75° F. Mean 5.4/inch @ 40° F. Mean |
| Compressive Strength (PSI @ 10% Deflection) | ASTM D1621 | 41 |
| Water Absorption (% by Volume) | ASTM C272 | 0.15 |
| Water Vapor Transmission (perm) | ASTM E96 | 0.8 |
| Fire Characteristics | UL 723/ ASTM E84 | |
| Flame Spread | | 10 |
| Smoke Developed | | 60–200 |
| Maximum Recommended Use Temperature (°F.) | | 165 |

The conventional mesh is ordinarily diamond-shaped with openings of about 7/16" in length and ¼" in height, see FIG. 4, with the same being arrayed in a uniform pattern so as to define keying means for the concrete. In a preferred embodiment, the conventional mesh for the main faces of the insulation board are satisfactory; however, it is preferred that the sheet have a ribbed pattern defining "V" grooves formed into the mesh so as to comprise a very efficient keying means and of sufficient thickness to have an outer surface offset outboard of the plane of the main face of the boards by about ⅛" to ¼" with the sheets being of a weight per yard of between 2½ and 4 pounds. The actual structure of the reinforcing sheet is seen in actual size in FIG. 4. The radiant barrier means has preferably an R-value of about 10 by reason of a highly reflective material so that the surface acts as the radiant barrier.

The vertical furring channel members are of common size and provide a pair of spaced generally parallel flanges on opposite sides of a web with the flanges being out turned at their terminal ends to provide a lip along each of the channel side walls. The six inch metal studs 4 and the six inch steel channel 1 as well as the six inch steel runner channel 19 provide framing means or means peripherally secured about the assembly of the insulation board and the channel members. The webs of the channel members or metal furring channels 5 are provided with spaced through holes so that upon mating relation or registry of opposing metal furring channels, one on each of the opposite sides of the insulation board, the assembly is in correct, generally stacked relation of the components, i.e., correctly aligned relatively to one another. Since the outer surface of the webs of these channel members are co-planar, this provides a support surface for an outer steel reinforcing sheet spanning each of the insulation board faces in spaced generally parallel relation thereto and this reinforcing sheet is preferably of metal open work with an array of openings, preferably diamond-shaped and preferably of a long length of about 2¾" and a short length of about 1¼" as shown in FIG. 5, in which it is seen that the strands of the reinforcing sheet are ribbed defining generally "V" grooves formed in the reinforcing sheet surface which comprise substantial keying means. Suitable fastening means preferably composed of a headed bolt and a threaded opposite end with mating nut are provided, which are also embedded in the concrete when the panel is completed and serve to align the members of the assembly. The relatively large openings of the reinforcing sheet provide an open cavity through which cementitious material may be applied to coat the reinforcing sheet and channel members in a cementitious bed, about midway depth-wise, hard coating each main face of the core.

Figure 3:
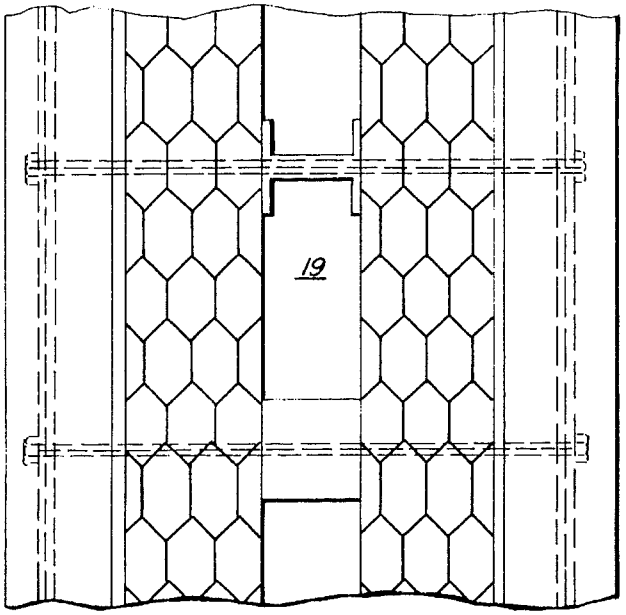
FIG. 3 is a view in cross-section of an alternative embodiment of a building panel and illustrating the core with a dead air space between two insulating boards.
Figure 2:
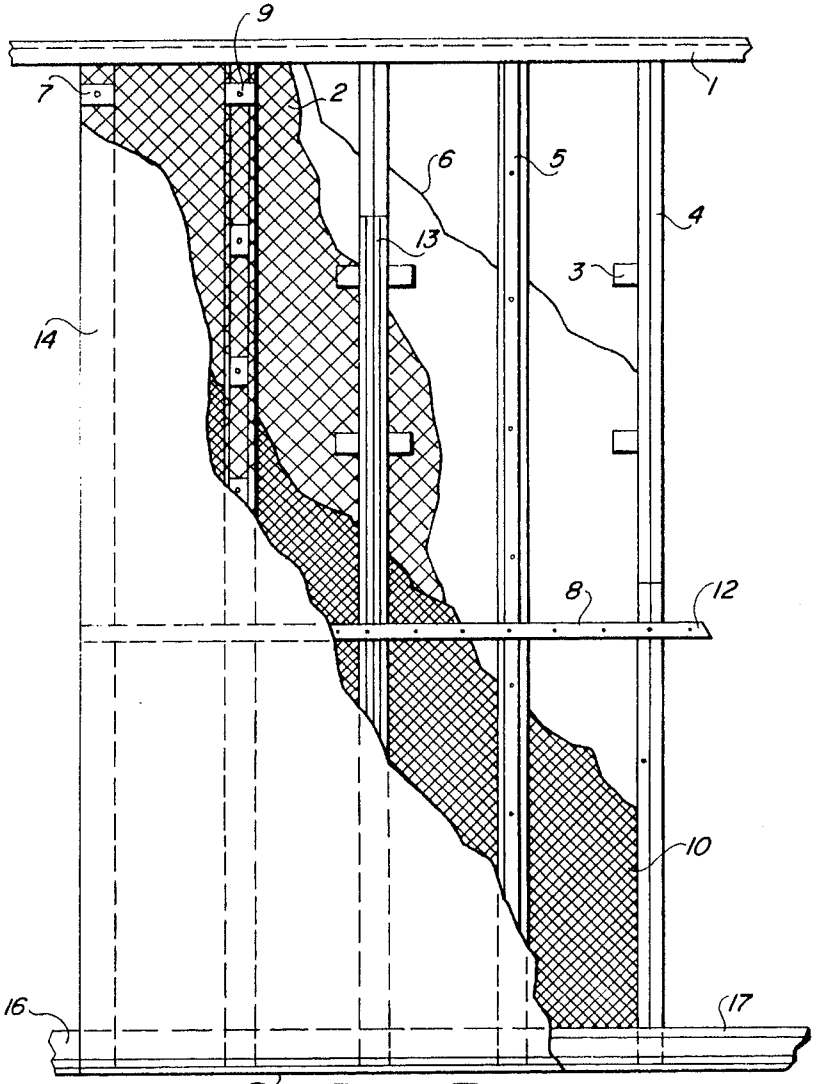
FIG. 2 is an elevation view of one of the main faces of the building panel shown in FIG. 1 which has been cutaway illustrating details thereof.

In another preferred embodiment, see FIG. 3, a central dead space 19 may be provided between a pair of spaced insulation boards as described herein. Preferably, the insulation board have the properties indicated in the following chart:

| Product Thickness | ½" | 1" | 1½" | 2 | 3 | 4 |
|---|---|---|---|---|---|---|
| R-Value @ 75° F. Mean Temp. | 2.7 | 5.0 | 7.5 | 10.0 | 15.0 | 20.0 |

and at least meet the following building co-agency, and industry requirements:

- Building Officials and Code Administrators International, Inc., BOCA Research Report 87–16;
- International Conference of Building Officials, ICBO Evaluation Report 4280;
- Southern Building Code Congress International, Inc., SBCCI Compliance Report 8682;
- Department of Housing and Urban Development, HUD, UMB-71;
- Metropolitan Dade County, Fla., Approval Number 88-0816.3;
- Underwriters Laboratories, Inc., See Classification Certificate A183;
- Standard Specification ASTM C578-87*a*, Type IV (formerly HH-I-524C).

In another preferred embodiment, especially for the wall of a bank, the reinforcing sheet embedded in the concrete cores may be a steel shield which cannot be easily penetrated. In such a core, the reinforcing sheet may be of steel expanded metal panels which provide penetration resistance as a shielding for the wall. Such a panel is useful for prisons, government offices, strip malls, computer rooms, courthouses, pharmacies, police stations, etc. Such reinforcing sheets are made of simultaneously cutting and stretching a solid sheet of steel making one continuous sheet instead of inner connected strands that can be unraveled. These security-type sheets because of the size of the diamond-shaped openings and the thickness of the steel are too tough for hand wire cutters and may be made of carbon steel or stainless steel. The reinforcing sheet of steel is preferably in conformance with the following industry standard specifications:

Carbon Steel-ASTM A569/A569M-85

Carbon Steel Security Mesh-Military Specification MIL-M-17194C Type I (for plaster) and Type II (for drywall), Class I Stainless Steel 304-ASTM-A-240-87

Stainless Steel Security Mesh-Military Specification MIL-S-46044A Type I and Type II There follow the dimensions of preferred shield embodiments:

| Lbs Per 100 Sq. Feet | Opening Size | Overall Thickness in Inches | % of Open Area |
|---|---|---|---|
| 140 | .500 1.26 | .070 | 57 |
| 171 | .923 2.12 | .120 | 63 |
| 75 | .923 2.10 | .070 | 73 |
| 51 | .923 2.10 | .048 | 75 |
| 41 | 1.090 2.56 | .048 | 77 |
| 111 | 1.330 3.20 | .110 | 77 |
| 57 | 1.330 3.20 | .070 | 80 |
| 38 | 1.330 3.20 | .048 | 82 |

While this invention has been shown and described in what is considered to be a practical and preferred embodiment, it is recognized that departures may be made within the spirit and scope of this invention which should, therefore, not be limited except as set forth in the Maims which follow and within the doctrine of equivalents.

What is claimed is:

1. A lightweight planar building panel core having two main faces for use in making a building panel core coated on the main faces with a cementitious material, said core comprising:

an extruded, square edged, rigid, non-containing formaldehyde polystyrene closed cell foam insulation board which is chemically inert of high compressive strength, of low moisture absorbing quality, which is resistant to soil chemicals, and contains a fire resistant compound, said board having a high longlasting resistance to heat flow (R-value) of between 2.5 and 20 at 75° Fahrenheit mean temperature, said board having i) an upper surface with opposite ends and a pair of generally parallel edges, ii) a bottom surface of a length substantially equal to that of said upper surface, with a pair of opposite ends and a pair of parallel edges, iii) parallel side surfaces, one extending from one of said upper surface ends and the other extending from the other of said upper surface ends to the bottom surface, and iv) two parallel board main faces spaced from one another between ½" and 4", and said board having at least the following property values according to the indicated tests for one foot square specimens which were aged and tested in accordance with FTC Rules (16 CFR, Part 460) and ASTM C578-87*a:*

| Property | Test | Value |
|---|---|---|
| Thickness (inches) | | ½, ⅝, 1, 1½, 2½, 3, 4 |
| Sheet Sizes (feet) | | 2' × 8', 4' × 8', 4' × 9' |
| R/Value (°F./ft.$^2$/hr./Btu$^{-1}$) | ASTM C518 | 5.0/inch @ 75° F. Mean 5.4/inch @ 40° F. Mean |
| Compressive Strength (PSI @ 10% Deflection) | ASTM D1621 | 41 |
| Water Absorption (% by Volume) | ASTM C272 | 0.15 |
| Water Vapor Transmission (perm) | ASTM E96 | 0.8 |
| Fire Characteristics | UL 723/ ASTM E84 | |
| Flame Spread | | 10 |
| Smoke Developed | | 60–200 |
| Maximum Recommended Use Temperature (°F.) | | 165 |

and at least meeting the following building code agency and industry requirements:

Building Officials and Code Administrators International, Inc., BOCA Research Report 87-16;

International Conference of Building Officials, ICBO Evaluation Report 4280;

Southern Building Code Congress International, Inc., SBCCI Compliance Report 8682;

Department of Housing and Urban Development, HUD, UMB-71;

Metropolitan Dade County, Florida, Approval Number 88-0816.3;

Underwriters Laboratories, Inc., See Classification Certificate A183;

Standard Specification ASTM C578-87*a*, Type IV (formerly HH-I-524C).

and having the thermal resistance properties shown in the following table:

| Product Thickness | ½" | 1" | 1½" | 2 | 3 | 4 |
|---|---|---|---|---|---|---|
| R-Value @ 75° F. Mean Temp. | 2.7 | 5.0 | 7.5 | 10.0 | 15.0 | 20.0 |

a generally congruent sheet of metal lath on each main face, each sheet having diamond-shaped openings approximately 7/16" long diamond length and ¼" short diamond length said openings being arrayed in a uniform pattern defining keys and thereby defining a mesh sheet, said sheet each having square ends and parallel selvedge edges, a protective coating, and said sheet having a ribbed pattern defining "V" grooves formed into the mesh sheet comprising self-furring and keying means of sufficient thickness offset outboard of the plane of each of the main faces by about ⅛" to ¼" and said sheets being of a weight per yard of between 2½" and 4 pounds, radiant barrier means of an R-value of about 10 of reflective material coating one of the main faces of the board, a plurality of spaced commonly shaped metal furring vertical channel members each extending across the main faces between the top and bottom surfaces, each channel member having a web with an inside surface and an outside surface and spaced parallel flanges extending outwardly from the mesh sheet a common distance and each flange having an out turned lip confronting the board and sheet and the outside surface of the webs of said channel members, said surface of said channel members being generally co-planar, upper and lower track means peripherally secured about the upper, lower and side surfaces of said combination of said board, sheets, and channel members, a steel reinforcing sheet spanning each board face and said reinforcing sheet comprising a metal open work structure with an array of diamond-shaped openings approximately 2¾" long diamond opening length and 1¼" short diamond opening length, said sheet having a ribbed pattern defining "V" grooves formed in the surface comprising keying means, and fastening means spaced along each channel member securing each channel member in spanning relation between the upper track means and the lower track means, and forming a assembly having an opening through which cementitious material may be applied to coat the core with the reinforcing sheet and the outside surfaces of said channel member being completely embedded and about midway depth-wise in a bed of cementitious material applied on each main face of the core.

2. The core as set forth in claim 1 wherein said reinforcing sheets each comprise a single exposed steel shield metal sheet of a thickness of between 0.048" and 0.120".

3. The core as set forth in claim 1 wherein the cementitious material is concrete.

4. The core as set forth in claim 1 wherein said board is substantially 3" in thickness.

5. The core as set forth in claim 1 wherein reinforcing rods are provided along said channel members.

6. The core as set forth in claim 1 wherein laterally extending bracing means are provided across the outer surface of adjacent channel members.

7. The core as set forth in claim 1 wherein the core is 4 feet in width and 8 feet in height.

8. The core as set forth in claim 3 wherein said reinforcing sheets each comprise a single exposed steel shield metal sheet of a thickness of between 0.048" and 0.120".

9. A core as set forth in claim 1 including a concrete outer coating on its main faces.

10. A lightweight planar building panel core having two main faces for use in making a building panel core with at least one main face coated on the main faces with a cementitious material, said core comprising:

said board having a high longlasting resistance to heat flow (R-value) of about 5R for each inch of thickness at 75° Fahrenheit mean temperature, said board having i) an upper surface with opposite ends and a pair of generally parallel edges, ii) a bottom surface of a length substantially equal to that of said upper surface, with a pair of opposite ends and a pair of generally parallel edges, iii) parallel side surfaces, one extending from one of said upper surface ends and the other extending from the other of said upper surface ends to the bottom surface, and iv) two parallel board main faces spaced from one another between ½" and 4", and said board having at least the following property values according to the indicated tests for one foot square specimens which were aged and tested in accordance with FTC Rules (16 CFR, Part 460) and ASTM C578-87*a*:

| Property | Test | Value |
|---|---|---|
| Thickness (inches) | | ½, ⅝, 1, 1½, 2½, 3, 4 |
| Sheet Sizes (feet) | | 2' × 8', 4' × 8', 4' × 9' |
| R/Value (°F./ft.$^2$/hr./Btu$^{-1}$) | ASTM C518 | 5.0/inch @ 75° F. Mean 5.4/inch @ 40° F. Mean |
| Compressive Strength (PSI @ 10% Deflection) | ASTM D1621 | 41 |
| Water Absorption (% by Volume) | ASTM C272 | 0.15 |
| Water Vapor Transmission (perm) | ASTM E96 | 0.8 |

and at least meeting the following building code requirements of:

Department of Housing and Urban Development, HUD, UMB-71;

a sheet of metal lath for at least one main face, an array of openings being arrayed in a uniform pattern defining keys and thereby defining a mesh sheet, said sheet having square ends and parallel selvedge edges, a protective coating, and said sheet having a ribbed pattern defining "V" grooves formed into the mesh sheet comprising self-furring and keying means, a plurality of spaced commonly shaped metal furring vertical channel members each extending across said at least one of said main faces between the top and bottom surfaces, each channel member having a web with an inside surface and an outside surface and spaced parallel flanges extending outwardly from the mesh sheet a common distance and each flange having an out turned lip confronting the board and sheet and the outside surface of the webs of said channel members, said surface of said channel members being generally co-planar, means peripherally securing said board, sheet, and channel members as an assembly, a steel reinforcing mesh sheet spanning said at least one of said board faces and said reinforcing sheet comprising a metal open work structure with an array of openings comprising keying means spaced outwardly from said at least one main face, fastening means interconnecting said assembly and reinforcing sheet means preferably securing, forming a partially open cavity into which cementitious material may be applied to coat said at least one main surface of the core with the concrete reinforcing sheet and the outside surfaces of said channel member being completely embedded and about midway depth-wise in a bed of cementitious material.

11. The core as set forth in claim 7 wherein said reinforcing sheets each comprise a single exposed steel shield metal sheet of a thickness of between 0.048" and 0.120".

12. A core as set forth in claim 7 including an outer concrete coating on said one of said main faces.

13. A planar building panel core having two main faces for use in making a building panel core coated on the main faces with a cementitious material, said core comprising:

an extruded, non-containing formaldehyde closed cell foam insulation board which is chemically inert of high compressive strength, of low moisture absorbing quality, said board having i) an upper surface with opposite ends ii) a bottom surface of a length substantially equal to that of said upper surface, iii) parallel side surfaces, a generally congruent sheet of metal lath on each main face, each sheet having preferably diamond-shaped openings, a plurality of spaced commonly shaped metal furring vertical channel members, a steel reinforcing sheet spanning each board face, fastening means spaced along each of said vertical channel members for securing each of said vertical channel members to a support structure.

* * * * *